United States Patent [19]

Czelen

[11] 4,036,357

[45] July 19, 1977

[54] CONTACT LENS CASES

[76] Inventor: John Cas Czelen, 550 Whitehaven Parkway NW., Washington, D.C. 20007

[21] Appl. No.: 649,022

[22] Filed: Jan. 14, 1976

[51] Int. Cl.[2] ..... A45C 11/04; B65D 85/54

[52] U.S. Cl. ..... 206/5.1; 220/375

[58] Field of Search ..... 206/5.1; 215/306; 220/375, 339, 337, 85 SP

[56] References Cited

U.S. PATENT DOCUMENTS

| | | | |
|---|---|---|---|
| 2,690,861 | 10/1954 | Tupper | 220/85 SP |
| 2,940,589 | 6/1960 | Silverman | 206/5.1 |
| 3,326,358 | 6/1967 | Singleton | 206/5.1 |
| 3,416,688 | 12/1968 | Fanning | 215/306 |
| 3,695,280 | 10/1972 | Sturgeon | 206/5.1 |

*Primary Examiner*—William T. Dixson, Jr.

[57] ABSTRACT

A fluid-tight contact lens storage and carrying case of small size of polyethylene or plastic-like material, preferably clear or of translucent color, allows contact lenses to be conveniently stored when not being worn, and provides a pocket and/or hand-bag carrying and/or overnight storage case therefor, and further provides for a fluid reservoir allowing dispensing of wetting/-cleaning fluid to the contact lens prior to insertion in the eye or storage in the case. The case as normally used comprises only one functional unit, but may be disassembled for initial filling or replenishing of the fluid reservoir.

1 Claim, 9 Drawing Figures

CONTACT LENS CASES

BACKGROUND

This invention relates to contact lens carrying cases and improvements permitting the integration of a fluid reservior with contact lens storage space, which further permits the dispensing of wetting/cleaning fluid necessary for application to a contact lens prior to insertion in the eye or prior to storage in the case.

Generally, a contact lens must be cleaned or treated with a wetting fluid prior to insertion in the eye. If dry lenses are inserted in the eye of the user, eye irritation may be caused, and in some instances, permanent damage to the eye may occur.

In the past, there have been various types of carrying cases for contact lenses. Although there have been designs incorporating both a facility for storing lenses and a means of dispensing wetting/cleaning fluid, a need exists for a compact, efficient, inexpensive design which permits convenient combined lens storage and application. Moveover, a design should have the minimum number of separable parts in order to prevent loss of any part while either using or carrying the case and to facilitate use of the device by persons with limited vision. Moveover, a design should provide that speed and ease of use by maximized.

SUMMARY

The invention provides a combination contact lens storage and carrying case and reservoir and dispenser of wetting/cleaning fluid which allows contact lenses to be conveniently stored when not being worn, and permits easy access to wetting/cleaning fluid.

The invention consists of a single cylindrical unit, composed of polyethylene or similar soft, flexible plastic, preferably clear or of translucent color. The central segment of the cylinder is hollow, providing a fluid reservoir for wetting/cleaning fluid. Attached to the upper end of the cylinder is a fluid dispensing structure, through which wetting/cleaning fluid may be dispensed by slight pressure on the side walls of the cylinder. The fluid dispensing structure is covered and protected from contamination and dirt by means of a snap-fit cap, connected to the cylinder by means of a thin flexible strap acting as a hinge.

The exterior base of the fluid reservoir segment is concavely recessed, providing space for the storage of a contact lens, parallel to the bottom end surface of the cylinder. A primary lens storage cap segment snap-fits onto the end of the cylinder, providing an enclosed storage space for a contact lens, and securing the lens therein. The primary lens storage cap is connected to the base of the cylinder by means of a thin flexible strap acting as a hinge in a similar fashion as the strap hinge of the fluid dispenser cap. The primary lens storage cap is also concavely recessed on its exterior base, providing storage space for a second lens. A secondary lens storage cap segment snap-fits onto the primary lens storage cap, providing an enclosed storage space for a second lens, and securing the lens therein. The secondary lens storage cap is connected to the primary lens storage cap by means of a thin flexible strap acting as a hinge in a similar fashion as the strap hinges of the fluid dispenser cap and primary lens storage cap.

To facilitate introduction of wetting/cleaning fluid into the interior of the fluid reservoir segment, two alternative structures are available. The first comprises a cylindrical extension on the base of the fluid dispensing structure which will snap-fit into a cylindrical fluid-tight fitting in the head of the main cylindrical fluid reservoir segment. Alternatively, the base of the fluid dispensing structure could be constructed with screw threads and could be screwed into or onto the head of the main cylindrical fluid reservoir segment, which would be compatibly threaded, and provide a fluid-tight fit. With either alternate stucture, the disassembly of the fluid dispensing structure from the fluid reservoir segment would not occur during the normal use of the contact lens storage spaces, or during the dispensing of the wetting/cleaning fluid, but would occur only when fluid need be introduced into the fluid reservoir.

These and other aspects of the invention will be more fully understood by referring to the following detailed description and accompanying drawings.

DRAWINGS

DETAILED DESCRIPTION

Figure 3:
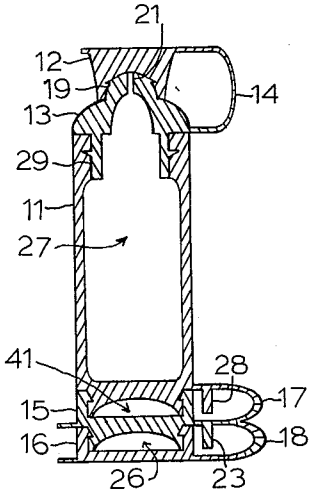
FIG. 3 shows a longitudinal cross-sectional view taken generally on line 3—3 of FIG. 1.
Figure 2:
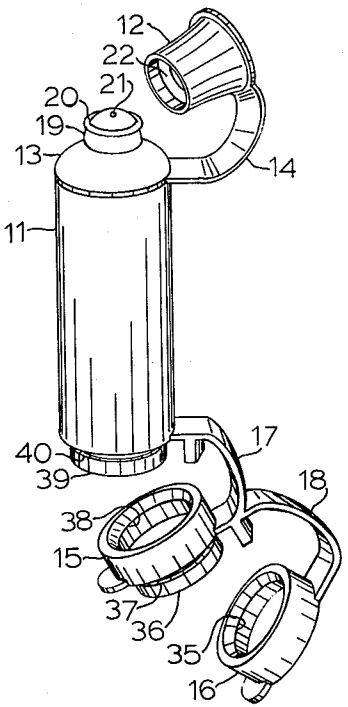
FIG. 2 shows a perspective view of the contact lens case with all hinged elements extended, with the fluid dispensing structure ready for dispensing and both storage sections open.
Figure 1:
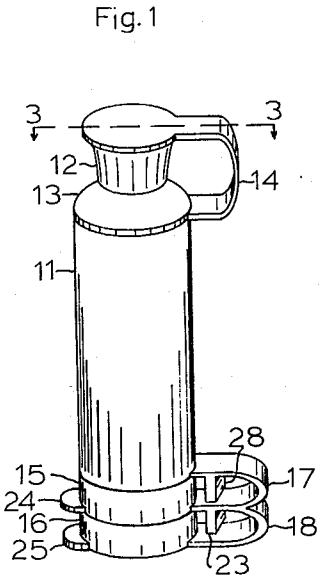
FIG. 1 shows a perspective view of the contact lens case as it is normally carried.

FIGS. 1, 2, and 3 show a combination contact lens storage and carrying case and reservoir and dispenser of wetting/cleaning fluid, of a generally cylindrical shape, approximately 2.5 inches in height, and 0.75 inches in diameter, comprised of a fluid reservoir segment 11, a fluid reservoir 27 located within the fluid reservoir segment 11, a fluid dispensing structure 13, a primary lens storage cap 15, and a secondary lens storage cap 16.

The fluid dispensing structure 13 has appended to it a nipple structure 19, through which a fluid channel 21 permits the fluid stored within the fluid reservoir 27 to flow out for application to a contact lens. The nipple structure 19 of the fluid dispensing structure 13 is protected by a fluid dispenser cap 12, which is connected to the fluid dispenser structure 13 by a strap hinge 14. A raised annulus 20 surrounds the nipple structure 19 and may engage a corresponding depressed annulus 22 in the fluid dispenser cap 12, thus securing the fluid dispenser cap 12 to the nipple structure 19 of the fluid dispensing structure 13. The raised annulus 20 and the fluid dispenser cap 12 are both flexible enough to permit the fluid dispenser cap 12 to be interlocked with the nipple structure 19, and to be placed in position on the nipple structure 19 or disengaged at will by directed pressure.

As shown in FIGS. 1 through 5, the primary lens storage cap 15 is connected to the base of the fluid reservior segment 11 by means of a strap hinge 17, and the secondary lens storage cap 16 is connected to the primary lens storage cap 15 by means of a strap hinge 18. Both hinges 17 and 18 each have a transverse reinforcing rib, respectively 28 and 23, to protect said straps from being broken or cracked by being doubled upon themselves too tightly or closely.

Figure 5:
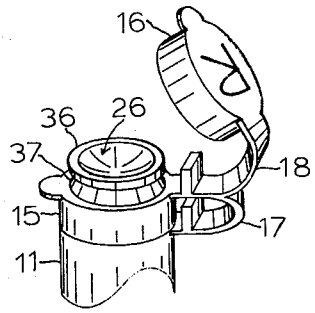
FIG. 5 shows a partial perspective view from below the contact lens case with the secondary lens storage space open.

As shown in FIGS. 2, 3, and 5, the primary lens storage cap 15 has a cylindrical extension 36, which is concavely excavated, forming a secondary lens storage space 26. The external circumferential base of the cylindrical extension 36 of the primary lens storage cap 15 has a depressed annulus 37 encircling it, which corresponds in size to a raised annulus 35 on the inside of the secondary lens storage cap 16, and permits the secondary lens storage cap 16 to be interlocked with the primary lens storage cap 15, securing and protecting the secondary lens stoages space 26. The raised annulus 35 on the secondary lens storage cap 16 and the cylindrical extension 36 of the primary lens storage cap 15 are both flexible enough to permit the lens storage caps 15 and 16 to be interlocked or disengaged at will. The base of the fluid reservoir segment 11 has a cylindrical extension 39 which is similar to the cylindrical extension 36 of the primary lens storage cap 15, and is also concavely excavated, forming a primary lens storage space 41. The external circumferential base of the cylindrical extension 39 has a depressed annulus 40 which corresponds in size to a raised annulus 38 on the primary lens storage cap 15, and permits the primary lens storage cap 15 to be interlocked with the fluid reservoir segment 11, securing and protecting the primary lens storage space 41, in a manner similar to the secondary lens storage space 26. Both lens storage caps 15 and 16 have appended to each of them a protruding lip, respectively 24 and 25, to aid disengagements of the caps from the remainder of the unit.

Figure 4:
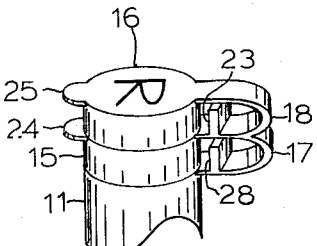
FIG. 4 shows a partial perspective view from below the contact lens case.

As shown in FIGS. 4 and 5, the secondary lens stogage cap 16 has a letter "R" embossed or raised upon its lower external surface to designate lens storage space 26 for the contact lens for the right eye. Alternatively, an "L" could be located on that surface, or some other such visual and tactile identification indicia.

Figure 6:
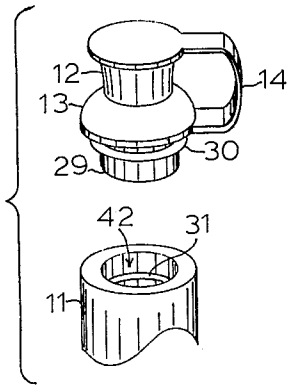
FIG. 6 shows an exploded partial perspective view of the snap-fit fluid dispensing structure removed from its normal position to facilitate filling of the fluid reservoir.

As shown in FIGS. 3 and 6, on the base of the fluid dispensing structure 13 is appended a cylindrical extension 29 which is of outside diameter equal to the inside diameter of an opening 42 in the top of the fluid reservoir segment 11. Thus, the fluid dispensing structure 13 can be inserted into the opening 42 of the fluid reservoir segment 11 providing a fluid-tight seal. Approximately midway on the length of the cylindrical extension 29 of the fluid dispensing structure 13 is a raised circumferential annulus 30, which corresponds in size to a depressed annular 31 on the inside of the opening 42, both of which interlock and prevent the fluid dispensing structure 13 from being withdrawn from the fluid reservoir segment 11 without a deliberate force, substantially greater than the force necessary to disengage the lens storage caps 15 and 16 or fluid dispenser cap 12. Thus, after the fluid reservoir 27 is filled with wetting/cleaning fluid, the fluid dispensing structure 13 is inserted, and interlocked, providing a fluid-tight structure that would remain interlocked in normal use.

Figure 7:
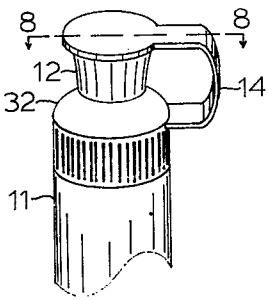
FIG. 7 shows a partial perspective view of an alternate fluid dispensing structure which includes a screw attachment.
Figure 9:
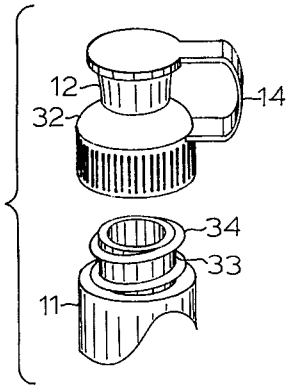
FIG. 9 shows an exploded partial perspective view of the screw-type fluid dispensing structure removed from its normal position to facilitate filling of the fluid reservoir.
Figure 8:
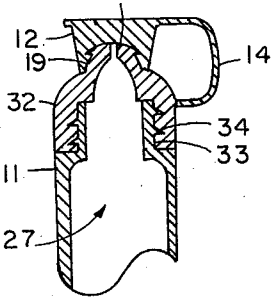
FIG. 8 shows a partial longitudinal cross-sectional view taken generally on line 8—8 of FIG. 7.

In FIGS. 7, 8, and 9, a modification is shown wherein the fluid dispensing structure 13 is altered to form fluid dispensing structure 32, which permits a threaded engagement with the fluid reservoir segment 11. In the illustrated alternative, the fluid reservoir segment 11 has appended to it a cylindrical extension 33 which is formed with screw threads 34. The diameter of the cylindrical extension 33 and the screw threads 34 corresponds to the inner surface of the alternative fluid dispensing structure 32, which is internally threaded, providing for ease of disattachment of the fluid dispensing structure 32 for access to the fluid reservior 27, while maintaining a fluid-tight seal when interlocked. Alternatively, the execution of the threaded engagement could differ, such as by appending the threaded cylindrical extension 33 to the base of the alternate fluid dispensing structure 32 and by having the internal surface of the opening 42 compatibly threaded.

I claim:

1. A contact lens case of one functional unit, there being no segments completely disattachable from the unit during normal use, constructed of a flexible, plastic-like material, comprising: a fluid reservoir of cylindrical design, a concave depression on the base of said reservior creating a primary storage space for a contact lens, a snap-fit primary lens storage cap covering the primary lens storage space, a protruding lip appended to the primary lens storage cap to aid manipulation, a strap hinge connecting said primary cap with said reservoir, a concave depression on the outer surface in the base of said primary lens storage cap creating a secondary storage space for a contact lens, a snap-fit secondary storage cap covering the secondary lens storage space, a protruding lip appended to the secondary lens storage cap to aid manipulation, a strap hinge connecting said secondary cap with the strap of the primary cap, transverse ribs on the strap hinges for the storage caps, a fluid dispensing structure on the upper end of the fluid reservoir cylinder, a snap-fit cap enclosing the fluid dispensing structure, an interlocking fit between the fluid dispensing structure and the fluid reservoir whereby the fluid dispensing structure may be releasably secured to said fluid reservoir cylinder, providing a fluid-tight seal, and separable to provide access to the fluid reservoir.

* * * * *